US008184082B2

(12) United States Patent
Tajiri

(10) Patent No.: US 8,184,082 B2
(45) Date of Patent: May 22, 2012

(54) LIQUID CRYSTAL DISPLAY AND METHOD OF DRIVING LIQUID CRYSTAL DISPLAY

(75) Inventor: Kenichi Tajiri, Ichinomiya (JP)

(73) Assignee: Epson Imaging Devices Corporation, Azumino-Shi (JP)

( * ) Notice: Subject to any disclaimer, the term of this patent is extended or adjusted under 35 U.S.C. 154(b) by 701 days.

(21) Appl. No.: 12/351,171

(22) Filed: Jan. 9, 2009

(65) Prior Publication Data

US 2009/0213058 A1 Aug. 27, 2009

(30) Foreign Application Priority Data

Feb. 25, 2008 (JP) ..... 2008-042508

(51) Int. Cl.
*G09G 3/36* (2006.01)

(52) U.S. Cl. ..... 345/96; 345/99

(58) Field of Classification Search ..... None
See application file for complete search history.

(56) References Cited

U.S. PATENT DOCUMENTS

| | | | | |
|---|---|---|---|---|
| 7,091,946 | B2 | 8/2006 | Tsutsui et al. | |
| 2006/0208985 | A1* | 9/2006 | Hwang et al. | 345/92 |
| 2006/0208992 | A1* | 9/2006 | Akutsu et al. | 345/98 |

FOREIGN PATENT DOCUMENTS

| | | |
|---|---|---|
| JP | A-2002-196358 | 7/2002 |
| JP | A-2004-12891 | 1/2004 |
| JP | A-2007-140192 | 6/2007 |

* cited by examiner

*Primary Examiner* — Andrew L. Sniezek
(74) *Attorney, Agent, or Firm* — Oliff & Berridge, PLC

(57) ABSTRACT

A liquid crystal display selectively operates in one of a full screen display mode, in which the full screen of the display panel is set as a display area, and a partial display mode, in which a partial area in the full screen is set as a display area and a remaining area is set as a non-display area. The liquid crystal display includes a plurality of gate lines, a plurality of source lines, a plurality of storage capacitor lines that are provided to correspond to the plurality of gate lines, a plurality of pixels that are provided at intersections between the plurality of gate lines and the plurality of source lines, a polarity signal generation circuit that generates a polarity signal corresponding to a frame inversion signal to be repeatedly alternately inverted between a first level and a second level different from the first level for each frame in the display area, and generates a polarity signal corresponding to a fixed signal fixed at one of the first level and the second level in the non-display area, a storage capacitor line driving circuit that changes the potentials of the storage capacitor lines depending on the polarity signal generated by the polarity signal generation circuit, and a control circuit that changes the display area at a timing according to the frame inversion signal.

12 Claims, 10 Drawing Sheets

DISPLAY AREA

NON-DISPLAY AREA
(WHEN OK)

NON-DISPLAY AREA
(WHEN NG)

LIQUID CRYSTAL DISPLAY AND METHOD OF DRIVING LIQUID CRYSTAL DISPLAY

BACKGROUND

1. Technical Field

The present invention relates to a storage capacitor line driving liquid crystal display and a method of driving a liquid crystal display.

2. Related Art

A storage capacitor line driving method is known as one of driving methods of liquid crystal displays. This driving method is configured such that a storage capacitor is provided between a storage capacitor line and a pixel electrode. After a display signal is written in the pixel electrode, if the potential of the storage capacitor line is changed, the potential of the pixel electrode is changed to positive or negative. With this configuration, the dynamic range of the display signal can be reduced, and the liquid crystal display can be driven with low power consumption. Such a storage capacitor line driving liquid crystal display is disclosed in JP-A-2002-196358.

A partial display method is known as one of display methods of liquid crystal displays. In this display method, a partial area of a pixel area serves as a display area where an image is displayed, and a remaining area serves as a non-display area (white or black display area) where no image is displayed.

In the storage capacitor line driving liquid crystal display, when partial display is performed, storage capacitor line driving is stopped in the non-display area, thereby achieving low power consumption. Such a liquid crystal display is disclosed in JP-A-2007-140192.

When storage capacitor line driving is stopped while a polarity signal for deciding the potential level of the storage capacitor line is set at the level for the previous frame, a change of a display area requires a complex operation. As a result, the circuit configuration becomes complicated.

In order to simplify the circuit configuration, in the non-display area, the polarity signal may be fixed at an L level or an H level. In this case, during a transition sequence, such as a transition from a full screen display mode to a partial display mode, a transition from a partial display mode to a full screen display mode, or a change of a display area in a partial display mode, defective display may occur in a first frame depending on the level for the previous frame.

SUMMARY

An advantage of some aspects of the invention is that it provides a liquid crystal display and a method of driving a liquid crystal display capable of achieving low power consumption without damaging display quality.

According to an aspect of the invention, there is provided a liquid crystal display that selectively operates in one of a full screen display mode, in which the full screen of the display panel is set as a display area, and a partial display mode, in which a partial area in the full screen is set as a display area and a remaining area is set as a non-display area. The liquid crystal display includes a plurality of gate lines, a plurality of source lines, a plurality of storage capacitor lines that are provided to correspond to the plurality of gate lines, a plurality of pixels that are provided at intersections between the plurality of gate lines and the plurality of source lines, a polarity signal generation circuit that generates a polarity signal corresponding to a frame inversion signal to be repeatedly alternately inverted between a first level and a second level different from the first level frame by frame in the display area, and generates a polarity signal corresponding to a fixed signal fixed at one of the first level and the second level in the non-display area, a storage capacitor line driving circuit that changes the potentials of the storage capacitor lines depending on the polarity signal generated by the polarity signal generation circuit, and a control circuit that changes the display area at a timing according to the frame inversion signal.

With this configuration, storage capacitor line driving can be activated in the display area, and storage capacitor line driving can be stopped in the non-display area. Therefore, the liquid crystal display can be driven with low power consumption. In addition, the display area is changed (a transition sequence is executed) depending on the frame inversion signal (frame polarity). For this reason, in a first frame when a transition sequence is executed, defective display can be suppressed. As such, low power consumption can be achieved without damaging display quality.

In the liquid crystal display according to the aspect of the invention, the control circuit may change the display area in a frame in which the level of the frame inversion signal is different from the fixed signal.

With this configuration, a frame in which a transition sequence is executed can be limited, and thus in a first frame when a transition sequence is executed, it is possible to suppress the occurrence of the problem of storage capacitor line driving being stopped in the display area and storage capacitor line driving being activated in the non-display area. As a result, defective display can be reliably suppressed.

In the liquid crystal display according to the aspect of the invention, the change of the display area may be one of a transition from the full screen display mode to the partial display mode, a transition from the partial display mode to the full screen display mode, and a change of the display area in the partial display mode.

With this configuration, when a transition sequence is executed to change the display area, defective display can be suppressed.

In the liquid crystal display according to the aspect of the invention, the polarity signal generation circuit may include a frame inversion signal generation circuit that generates the frame inversion signal, a memory that stores data for identifying the display area and the non-display area, and a logic circuit that, when data output from the memory indicates the display area, outputs the polarity signal corresponding to the frame inversion signal, and when data output from the memory indicates the non-display area, outputs the polarity signal corresponding to the fixed signal. The control circuit may update data stored in the memory to change the display area.

Therefore, with comparatively simple circuit configuration, the polarity signal to be inverted for each frame can be generated in the display area, and the polarity signal fixed at an L level (or H level) can be generated in the non-display area.

In the liquid crystal display according to the aspect of the invention, the logic circuit may be an AND circuit to which data output from the memory and the frame inversion signal generated by the frame inversion signal generation circuit are applied.

With this configuration, the polarity signal can be generated with simple circuit configuration.

In the liquid crystal display according to the aspect of the invention, each of the pixels may include a pixel switching element that is connected to a corresponding source line, a corresponding gate line, and a corresponding pixel electrode, and when the gate line is selected, allows electricity to be conducted between the pixel electrode and the source line, a pixel capacitor that is interposed between the pixel electrode and a common electrode to which a common potential is applied, and a storage capacitor that is interposed between the pixel electrode and a corresponding storage capacitor line. In the partial display mode, the common potential may be applied to the pixel electrodes of the pixels corresponding to the none display area.

With this configuration, in the non-display area of the partial display mode, the common potential is supplied to perform image display (non-display), and a so-called source write operation to write display signals from the source line driving circuit in the pixels can be stopped. Therefore, in the partial display mode which requires low power consumption, low power consumption can be achieved.

In the liquid crystal display according to the aspect of the invention, a switching element may be provided which is connected to a power supply line for supplying the common potential and the source line, and allows electricity to be conducted between the power supply line and the source line at a predetermined timing. In the non-display area of the partial display mode, the switching element may be controlled for one horizontal scanning period to allow electricity to be conducted between the power supply line and the source line.

Therefore, with comparatively simple circuit configuration, the common potential (non-display signal) can be supplied to the pixels of the non-display area.

According to another aspect of the invention, there is provided a method of driving a liquid crystal display, which selectively operates in one of a full screen display mode, in which the full screen of the display panel is set as a display area, and a partial display mode, in which a partial area in the full screen is set as a display area and a remaining area is set as a non-display area. The liquid crystal display includes a plurality of gate lines, a plurality of source lines, a plurality of storage capacitor lines that are provided to correspond to the plurality of gate lines, and a plurality of pixels that are provided at intersections between the plurality of gate lines and the plurality of source lines. The method comprising generating a polarity signal corresponding to a frame inversion signal to be repeatedly inverted between a first level and a second level frame by frame in the display area, and generating a polarity signal corresponding to a fixed signal fixed at one of the first level and the second level in the non-display area, changing the potentials of the storage capacitor lines depending on the polarity signal, and changing the display area at a timing according to the frame inversion signal.

With this configuration, it is possible to provide a method of driving a liquid crystal display that can achieve low power consumption without damaging display quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the drawings.

Figure 1:
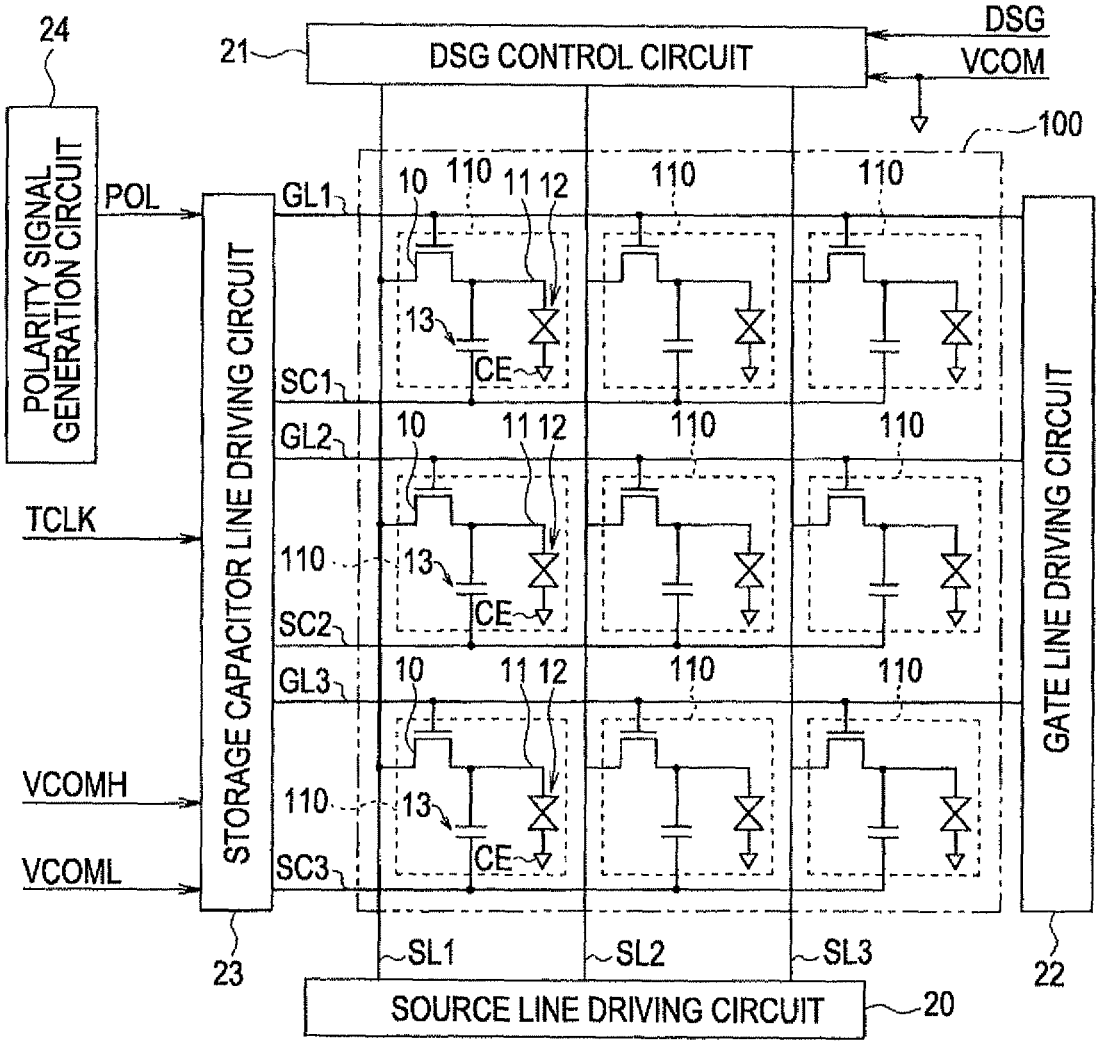
FIG. 1 is a block diagram showing the configuration of a liquid crystal display according to an embodiment of the invention.

FIG. 1 is a block diagram showing the configuration of a liquid crystal display according to this embodiment.

As shown in FIG. 1, a liquid crystal display has a pixel area 100. A source line driving circuit 20, a DSG control circuit 21, a gate line driving circuit 22, a storage capacitor line driving circuit 23, and a polarity signal generation circuit 24 are arranged around the pixel area 100. It is assumed that the liquid crystal display of this embodiment uses a storage capacitor line driving method.

The pixel area 100 has a plurality of pixels 110, and 320 rows of gate lines GL and 240 columns of source lines SL extending in a row (X) direction and a column (Y) direction, respectively. The pixels 110 are arranged at intersections between the gate lines GL of the first to 320th rows and the source lines SL of the first to 240th columns. Storage capacitor lines SC extend in the X direction to correspond to the gate lines GL of the first to 320th rows.

In this embodiment, the pixels 110 are arranged in a matrix of 320 rows×240 columns in the pixel area 100, but the invention is not limited to this arrangement.

The liquid crystal display of this embodiment selectively operates in one of a full screen display mode in which the full screen of the pixel area 100 is set as a display area, and a partial display mode in which a partial area of the full screen is set as a display area and a remaining area is set as a non-display area.

Figure 2:
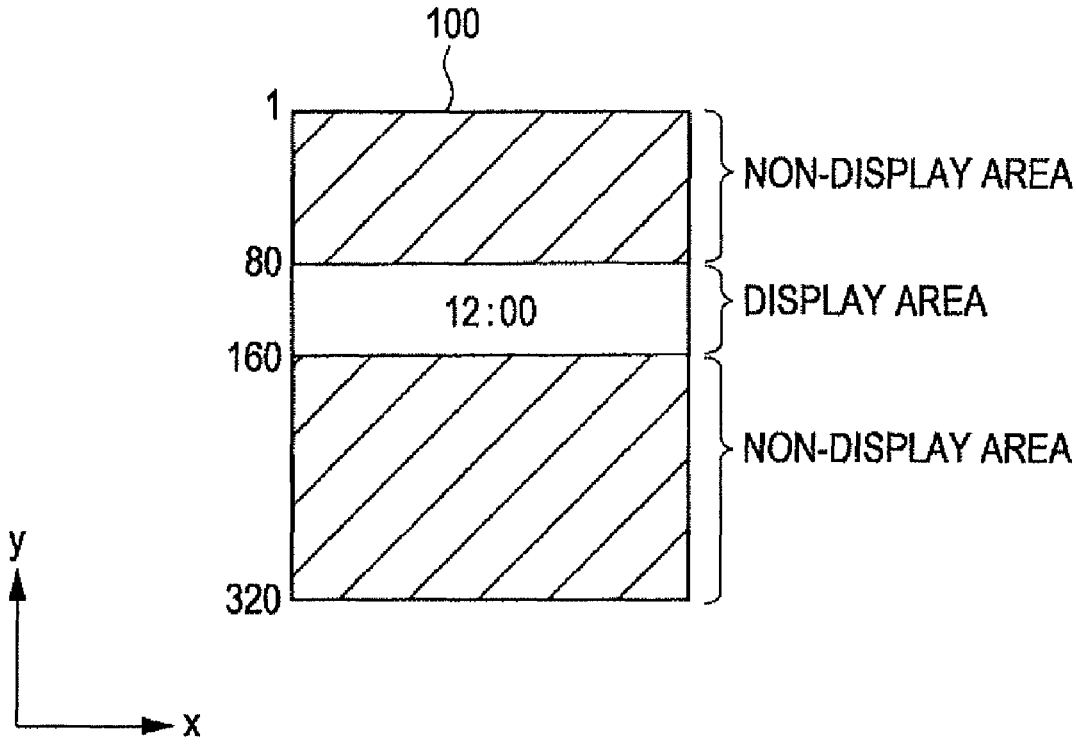
FIG. 2 is a diagram showing a display area in a partial display mode.

FIG. 2 is a diagram showing a display area in a partial display mode.

In the partial display mode, as shown in FIG. 2, an image (time or remaining battery charge) is displayed only in a display area including the pixels of the 80th to 160th rows from an upper end in a vertical direction (y direction), and no image is displayed in a remaining area, that is, in a non-display area. That is, in the case of a normally white mode, white is displayed in the non-display area, and in the case of a normally black mode, black is displayed in the non-display area.

Next, the detailed configuration of each pixel 110 will be described.

In FIG. 1, for simplification, 9 pixels 110 formed in 3 rows×3 columns are shown. Each pixel 110 has an n-channel thin film transistor (hereinafter, referred to as TFT) 10 serving as a pixel switching element, a pixel capacitor (liquid crystal capacitor) 12, and a storage capacitor 13. The pixels 110 have the same configuration, and thus a description will be provided for the pixel 110 of the first row and first column. In the pixel 110 of the first row and the first column, a gate electrode of the TFT 10 is connected to the gate line GL1 of the first row, a source electrode of the TFT 10 is connected to the source line SL1 of the first column, and a drain electrode of the TFT 10 is connected to a pixel electrode 11 serving as one end of the pixel capacitor 12.

The other end of the pixel capacitor 12 is connected to a common electrode CE. The common electrode CE is common to all the pixels 110, as shown in FIG. 1, and is supplied with a common signal VCOM. In this embodiment, the common signal VCOM is temporally constant at a voltage LCCOM.

The pixel area 100 is formed by bonding a pair of substrates, that is, an element substrate having formed thereon the pixel electrodes 11 and a counter substrate having formed thereon the common electrode CE, such that the electrode forming surfaces of the substrates face each other with a predetermined gap therebetween, and by filling the gap with liquid crystal. Therefore, the pixel capacitor 12 is formed by each pixel electrode 11 and the common electrode CE with liquid crystal as a kind of dielectric interposed therebetween, and holds a differential voltage between the pixel electrode 11 and the common electrode CE. With this configuration, the amount of light that can be transmitted by the pixel capacitor 12 varies depending on the effective value of the held voltage.

In this embodiment, it is assumed that a normally white mode is set. In the normally white mode, if the effective value of the voltage held in the pixel capacitor 12 approaches zero, transmittance is maximized, and white display is performed, meanwhile, as the effective voltage value increases, the amount of light transmitted decreases, and transmittance is minimized, thereby performing black display.

In the pixel 110 of the first row and first column, one end of the storage capacitor 13 is connected to the pixel electrode 11 (the drain electrode of the TFT 10), and the other end of the storage capacitor 13 is connected to the storage capacitor line SC1 of the first row.

The gate line driving circuit 22 supplies gate signals G1, G2, G3, . . . , and G320 to the gate lines GL of the first, second, third, . . . , and 320th rows during one vertical scanning period (one frame period), respectively. That is, the gate line driving circuit 22 sequentially selects the gate lines GL in order of the first, second, third, . . . , and 320th rows, sets the gate signal to the selected gate line GL at an H level corresponding to a selection voltage, and sets the gate signals to other gate lines GL at an L level corresponding to a non-selection voltage (ground potential Gnd).

The source line driving circuit 20 supplies source signals (display signal) Sig1, Sig2, Sig3, . . . , and Sig240 having voltage levels according to the gray-scale levels of the pixels 110 in the gate line GL selected by the gate line driving circuit 22 to the first, second, third, . . . , and 240th source lines SL.

The source line driving circuit 20 has storage areas (not shown) corresponding to the matrix arrangement of 320 rows×240 columns, and each storage area stores display data assigning the gray-scale level (brightness) of a corresponding one of the pixels 110. Display data stored in each storage area is rewritten when the display content is changed.

For the first to 240th columns in the selected gate line GL, the source line driving circuit 20 executes an operation to read out display data of the pixels 110 in the selected gate line CL from the storage areas, to convert display data to the display signals Sig having voltage levels according to the gray-scale levels with assigned polarities, and to supply the display signals to the source lines SL.

Figure 3:
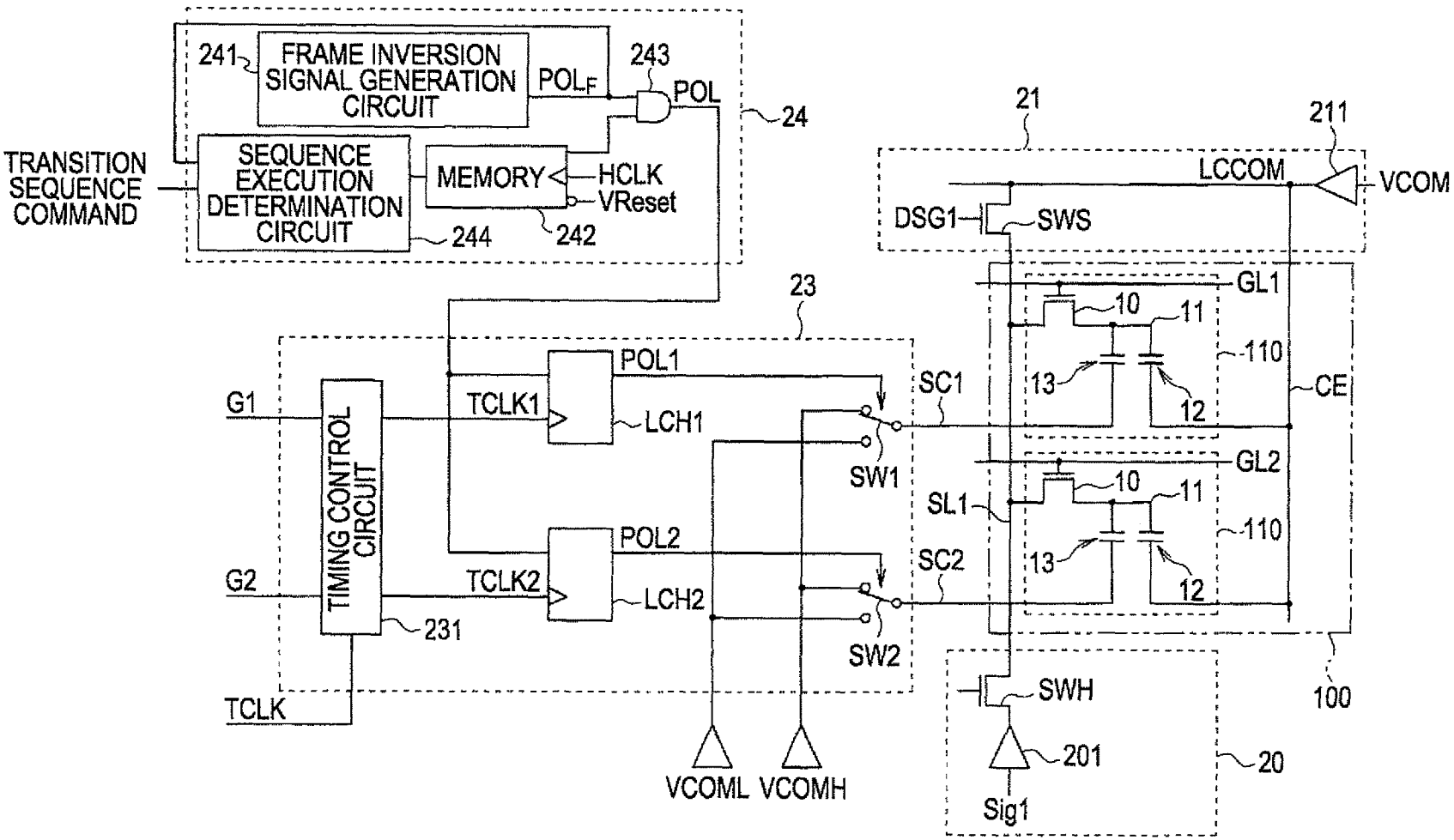
FIG. 3 is a block diagram showing the detailed configuration of peripheral circuits in a pixel area.

FIG. 3 is a block diagram showing the detailed configuration of peripheral circuits of the pixel area 100.

One end of the source line SL is connected to an output terminal of a source driver 201 through a horizontal switch SWH in the source line driving circuit 20. The horizontal switch SWH is switched in accordance with a horizontal scanning signal. If the horizontal switch SWH is turned on, the display signal Sig is supplied from the source driver 201 to the source line SL. In this way, a so-called source write operation is performed to write the display signal Sig from the source line driving circuit 20 in the pixel electrode 11.

The DSG control circuit 21 is supplied with a control signal DSG and the common signal VCOM. As shown in FIG. 3, the DSG control circuit 21 outputs the common potential LCCOM to the source line SL through a switch SWS. The switch SWS is turned on/off in accordance with the control signal DSG, and thus the common potential LCCOM is supplied from a common electrode driver 211 to the source line SL.

The control signal DSG is set to be at an H level in the non-display area during the partial display mode. Therefore, in the non-display area, the switch SWS is turned on, the source line SL and the common electrode CE are short-circuited, and thus the common potential LCCOM is supplied to the source line SL. Subsequently, if the TFT 10 is turned on in accordance with the gate signal C from the gate line driving circuit 22, the common potential LCCOM is applied to the pixel electrode 11. In this way, the voltage to be applied to the pixel capacitor 12 is approximately 0 V, and a non-display state is obtained.

Hereinafter, an operation to write the common potential LCCOM from the common electrode driver 211 in the pixel electrode 11 corresponding to the non-display area is referred to as a COM write operation.

The polarity signal generation circuit 24 includes a frame inversion signal generation circuit 241, a memory 242, an AND circuit 243, and a sequence execution determination circuit 244. The sequence execution determination circuit 244 corresponds to a control circuit.

The frame inversion signal generation circuit 241 generates a frame inversion signal $POL_F$ indicating a frame polarity to be repeatedly inverted between an H level and an L level frame by frame.

The memory 242 stores data for identifying a display area, in which an image is displayed, and a non-display area, in which no image is displayed, in the pixel area 100 to correspond to each line (each row). The value of data is "1" in the display area, and "0" in the non-display area. The memory 242 may be formed by, for example, a shift register, and holds and shifts data in synchronization with a clock HCLK, which is a pulse signal having a cycle of one horizontal scanning period (1H period).

The frame inversion signal $POL_F$ generated by the frame inversion signal generation circuit 241 and data read out from the memory 242 in synchronization with the clock HCLK are input to the two-input AND circuit 243.

When data read out from the memory 242 indicates the display area, that is, the value of data is "1", the AND circuit 243 outputs the frame inversion signal $POL_F$ as a polarity signal POL. When data read out from the memory 242 indicates the non-display area, that is, the value of data is "0", the output of the AND circuit 243 is fixed at "0". In this case, the AND circuit 243 outputs the polarity signal POL fixed at "0" (=L level).

Therefore, in the display area, the polarity signal POL corresponding to the frame inversion signal $POL_F$ to be inverted for each frame is output, and in the non-display area, the polarity signal POL corresponding to a fixed signal (L level) is output.

The sequence execution determination circuit 244 receives a display area change signal (transition sequence command) and the frame inversion signal $POL_F$, and when a transition sequence command to request a transition sequence, such as a transition from the full screen display mode to the partial display mode, a transition from the partial display mode to the full screen display mode, or a change of the display area in the partial display mode, is input, determines an execution timing of the transition sequence on the basis of the frame inversion signal $POL_F$.

Figure 4:
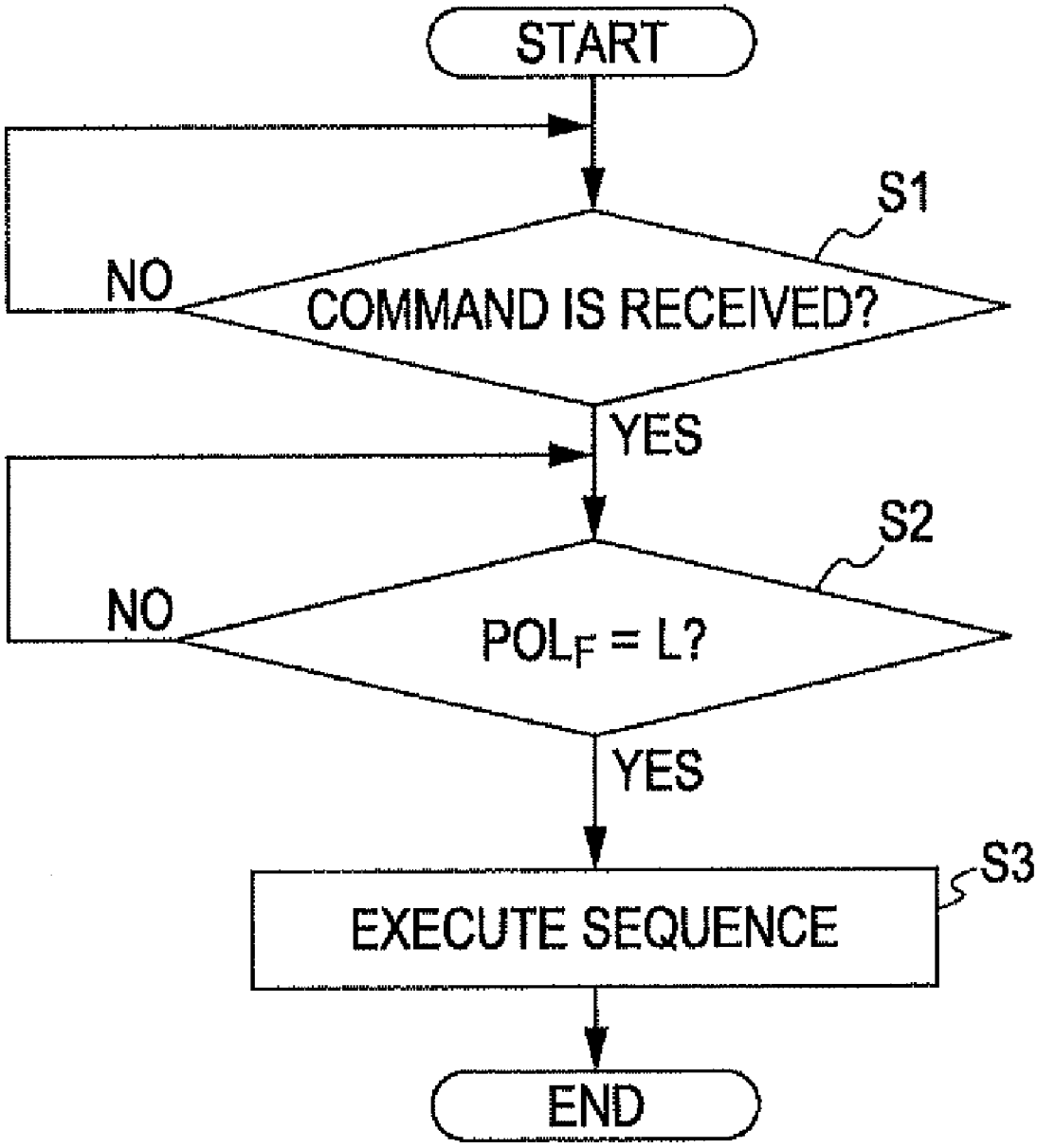
FIG. 4 is a flowchart showing a sequence execution determination processing to be executed by a sequence execution determination circuit.

FIG. 4 is a flowchart showing a sequence execution determination processing to be executed by the sequence execution determination circuit 244.

In the sequence execution determination processing, first, in Step S1, it is determined whether or not a transition sequence command to request a transition from the full screen display mode to the partial display mode, a transition from the partial display mode to the full screen display mode, or a change of the display area in the partial display mode is received. When the transition sequence command is not received, the process waits until the transition sequence command is received. When the transition sequence command is received, the process progresses to Step S2.

In Step S2, it is determined whether or not the frame inversion signal $POL_F$ is at the L level, and when $POL_F$=H, the process waits until $POL_F$=L. When $POL_F$=L the process progresses to Step S3.

In Step S3, the transition sequence is executed, and data stored in the memory 242 is rewritten.

Therefore, when a transition from the full screen display mode to the partial display mode, a transition from the partial display mode to the full screen display mode, or a change of the display area in the partial display mode is performed, the frame inversion signal $POL_F$ is detected, and a corresponding transition sequence is performed for a frame next to a frame in which $POL_F$=L, that is, in a frame in which the level of the frame inversion signal $POL_F$ is different from the polarity signal POL (the L level of the fixed signal) in the non-display area.

A signal Vreset is synchronous with a vertical synchronizing signal Vsync and used to reset a read counter of the memory 242.

Next, the configuration of the storage capacitor line driving circuit 23 will be described. For simplification of explanation, FIG. 3 shows first and second storage capacitor lines SC1 and SC2.

The polarity signal POL output from the polarity signal generation circuit 24 is latched by first and second latch circuits LCH1 and LCH2, which are provided to correspond to the first and second storage capacitor lines SC1 and SC2, on the basis of first and second timing clocks TCLK1 and TCLK2, respectively. The first and second latch circuits LCH1 and LCH2 output and hold the latched polarity signal POL as first and second latch signals POL1 and POL2.

The first and second timing clocks TCLK1 and TCLK2 are created by a timing control circuit 231 on the basis of the gate signals G1 and G2 and a timing control signal TCLK.

The first and second latch signals POL1 and POL2 are used to control switching of first and second switches SW1 and SW2 at a subsequent stage. For example, when the first latch signal POLL is at an H level, a low potential VCOML is applied to the first storage capacitor line SC1, and when the first latch signal POL1 is at an L level, a high potential VCOMH is applied to the first storage capacitor line SC1.

That is, the potentials of the first and second storage capacitor lines SC1 and SC2 are decided by the rising timing of the first and second timing clocks TCLK1 and TCLK2, respectively. In such as storage capacitor line driving method, such a timing is generally after the gate signals G1 and G2 fall.

A transition sequence may be performed in a frame immediately after a transition sequence command is received, regardless of the frame inversion signal $POL_F$, while the sequence execution determination processing is not performed by the sequence execution determination circuit 244. In this case, the frame inversion signal $POL_F$ may affect display in a first frame during a transition sequence. This will be described below.

Figure 5:
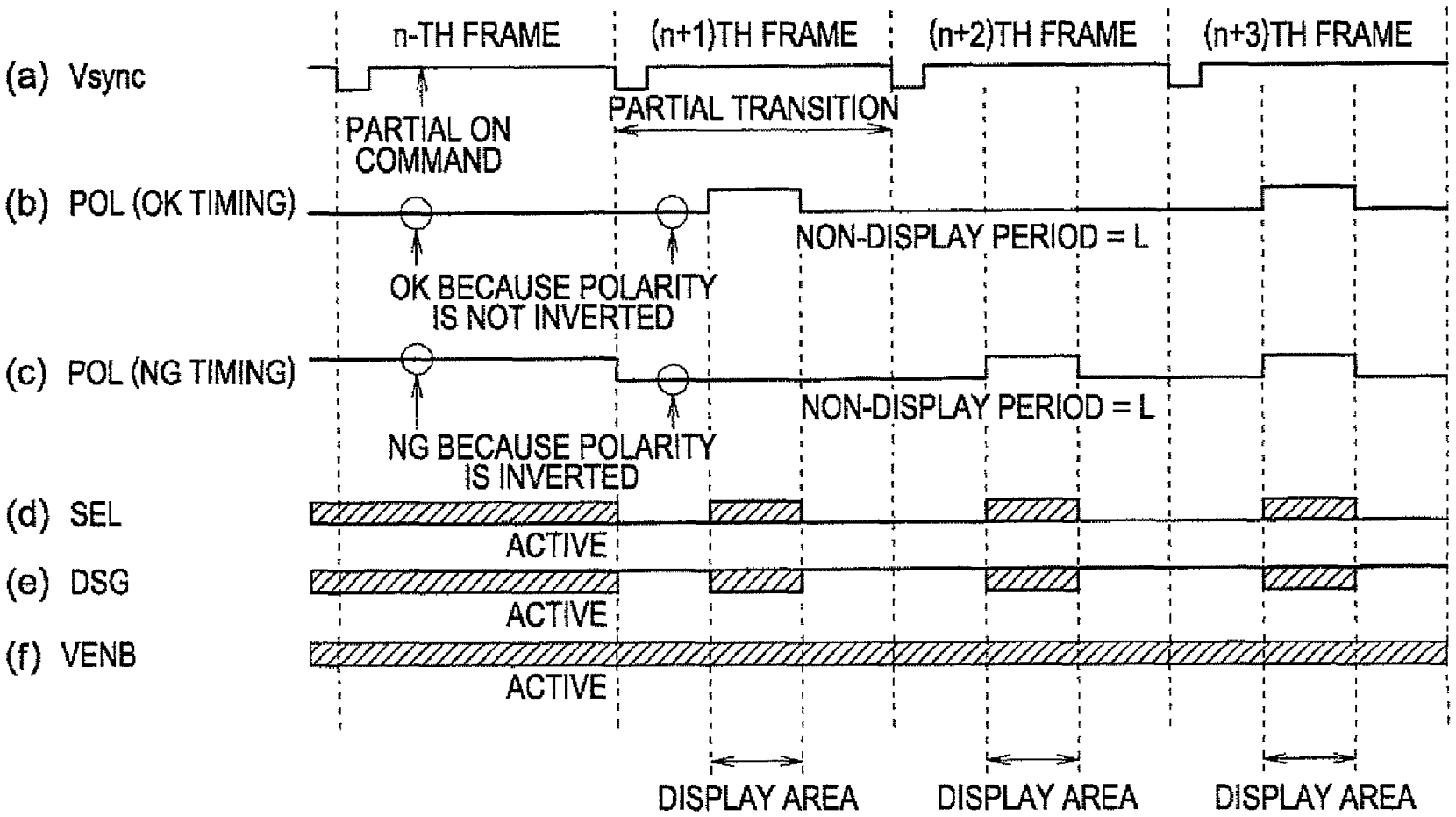
FIG. 5 is a timing chart illustrating an operation during a transition from a full screen display mode to a partial display mode without performing a sequence execution determination processing.

FIG. 5 is a timing chart illustrating an operation during a transition from a full screen display mode to a partial display mode without performing sequence execution determination processing.

In FIG. 5, (a) Vsync is a vertical synchronizing signal for indicating a start timing of one vertical scanning period, (b) and (c) POL are polarity signals, (d) SEL is a display signal to be supplied from the source line driving circuit 20 to the source line SL, (d) DSG is a control signal, and (f) VENB is a gate selection enable signal.

During the full screen display mode, in one frame period, the display signals Sig are successively supplied from the source line driving circuit 20 to the source lines SL. Therefore, the display signals are supplied to all the pixel electrodes 11 in the display area, and thus full screen display is performed.

In this case, the memory 242 stores data "1" for all the lines. Therefore, in an n-th frame, when the frame inversion signal $POL_F$ generated by the frame inversion signal generation circuit 241 is at the L level, as shown in (b) of FIG. 5, the polarity signal POL=L for all the lines. When the frame inversion signal $POL_F$ is at the H level, as shown in (c) of FIG. 5, the polarity signal POL=H for all the lines.

In the n-th frame, if a command (partial ON command) to request a transition from the full screen display mode to the partial display mode is received, and data of the memory 242 corresponding to each line of the non-display area is rewritten from "1" to "0", the display mode is switched to the partial display mode in an (n+1)th frame.

As described above, according to this embodiment, since frame inversion driving is performed, as shown in (b) of FIG. 5, when $POL_F$=L (POL=L) in the n-th frame, in the (n+1)th frame and later, the level of the polarity signal POL changes in the following manner H→L→H→ . . . with respect to the lines corresponding to the display area frame by frame. The polarity signal POL is fixed at the L level with respect to the lines of the non-display area.

As shown in (c) of FIG. 5, when $POL_F$=H (POL=H) in the n-th frame, in the (n+1)th frame and later, the level of the polarity signal POL changes in the following manner L→H→L→ . . . with respect to the lines corresponding to the display area frame by frame. The polarity signal POL is fixed at the L level with respect to the lines corresponding to the non-display area.

In this case, a source write operation to write the display signals Sig from the source line driving circuit 20 in the pixel electrodes 11 corresponding to the display area is performed. In the non-display area, the control signal DSG is maintained at the H level, and a COM write operation to write the common potential LCCOM from the common electrode driver 211 in the pixel electrode 11 corresponding to the non-display area is performed.

Figure 6:
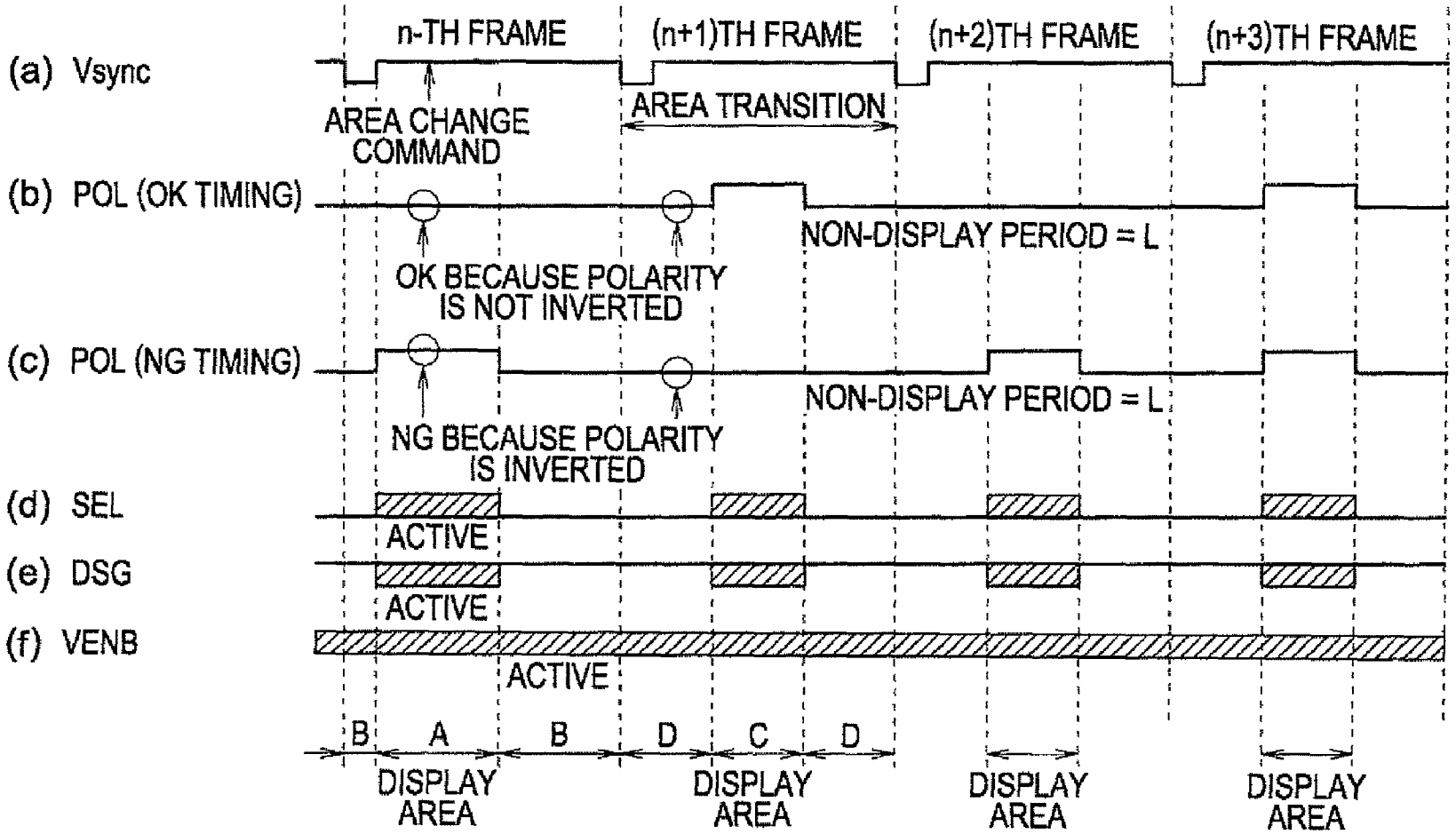
FIG. 6 is a timing chart illustrating an operation during a change of a display area in a partial display mode without performing a sequence execution determination processing.

FIG. 6 is a timing chart illustrating an operation during a change of a display area in a partial display mode without performing sequence execution determination processing.

In the n-th frame, an area A is set as a display area, and an area B is set as a non-display area. In this case, in the memory 242, data "1" is stored with respect to the lines corresponding to the area A, and data "0" is stored with respect to the lines corresponding to the area B.

Therefore, in the n-th frame, when the frame inversion signal $POL_F$ is at the L level, as shown in (b) of FIG. 6, the polarity signal POL=L for all the lines. When the frame inversion signal $POL_F$ is at the H level, as shown in (c) of FIG. 6, the polarity signal POL=H with respect to the lines corresponding to the display area (area A), and the polarity signal POL=L with respect to the lines corresponding to the non-display area (area B).

In the n-th frame, if a command to request a change of a display area in a partial display mode (area change command) is received, data in the memory 242 corresponding to the lines of a new display area (area C) is rewritten to "1", and data in the memory 242 corresponding to the lines of a new non-display area (area D) is rewritten to "0", the display area is switched from the area A to the area C in the (n+1)th frame.

Therefore, as shown in (b) of FIG. 6, when $POL_F$=L in the n-th frame, in the (n+1)th frame and later, the level of the polarity signal POL changes in the manner H→L→H→ . . . with respect to the lines corresponding to the display area (area C) frame by frame. The polarity signal POL is fixed at the L level with respect to the lines corresponding to the non-display area (area D).

As shown in (c) of FIG. 6, if $POL_F$=H in the n-th frame, in the (n+1)th frame and later, the level of the polarity signal POL changes in the manner L→H→L→ . . . with respect to the lines corresponding to the display area (area C) frame by frame. The polarity signal POL is fixed at the L level with respect to the lines corresponding to the non-display area (area D).

Figure 7:
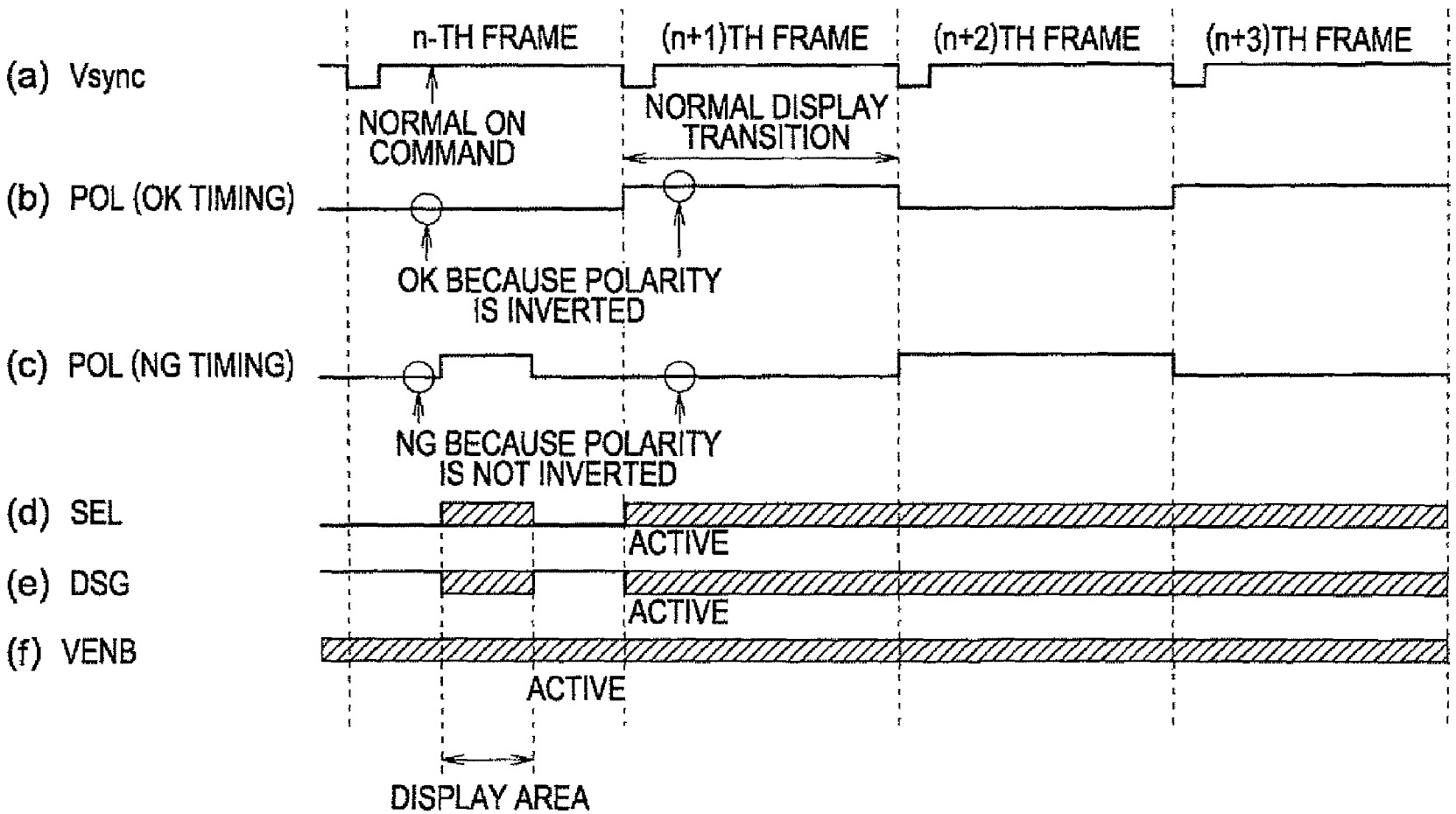
FIG. 7 is a timing chart illustrating an operation during a transition from a partial display mode to a full screen display mode without performing a sequence execution determination processing.

FIG. 7 is a timing chart illustrating an operation during a transition from the partial display mode to the full screen display mode without performing sequence execution determination processing.

In the n-th frame, an area A is set as a display area, and an area B is set as a non-display area. In this case, in the memory 242, data "1" is stored with respect to the lines corresponding to the area A, and data "0" is stored with respect to the lines corresponding to the area B.

Therefore, in the n-th frame, when the frame inversion signal $POL_F$ is at the L level, as shown in (b) of FIG. 7, the polarity signal POL=L for all the lines. When the frame inversion signal $POL_F$ is at the H level, as shown in (c) of FIG. 7, the polarity signal POL=H with respect to the lines corresponding to the display area (area A), and the polarity signal POL=L with respect to the lines corresponding to the non-display area (area B).

In the n-th frame, if a command to request a transition from the partial display mode to the full screen display mode (normal ON command) is received, and data in the memory 242 corresponding to the lines of the area B is rewritten from "0" to "1", the display mode is switched to the full screen display mode in the (n+1)th frame.

Therefore, as shown in (b) of FIG. 7, when $POL_F$=L in the n-th frame, in the (n+1)th frame and later, the level of the polarity signal POL changes in the following manner H→L→H→ . . . frame by frame. As shown in (c) of FIG. 7, when $POL_F$=H in the n-th frame, in the (n+1)th frame and later, the level of the polarity signal POL changes in the following manner L→H→L→ . . . frame by frame.

Next, a change of a pixel potential by storage capacitor line driving will be described with reference to FIGS. 8A to 8C.

Figure 8A:
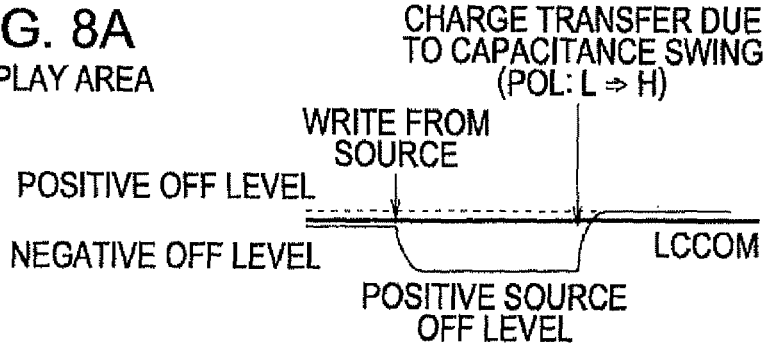
FIG. 8 is a diagram illustrating a change of a pixel potential by storage capacitor line driving.

FIG. 8A shows a change of a pixel potential when the state POL=L is changed to the state POL=H in driving the display area. As shown in FIG. 8A, when the display area is driven, after the display signal is written in the pixel electrode 11 through the source line SL, if the switch SW of the storage capacitor line driving circuit 23 swings, the potential of the corresponding storage capacitor line SC is changed. As a result, the potential of the pixel electrode 11 is changed to positive.

After the display signal is written in the pixel electrode 11 through the source line SL, if storage capacitor line driving (capacitance swing) is performed, the dynamic range of the display signal can be reduced, and thus the liquid crystal display can be driven with low power consumption. Meanwhile, after the display signal is written in the pixel electrode 11 through the source line SL, if storage capacitor line driving is not performed, a write operation may not be sufficiently performed, and an adverse effect on display may occur.

Figure 8B:
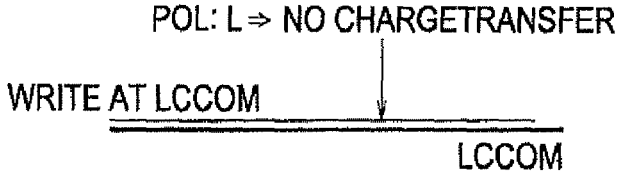

FIG. 8B shows a transition of a pixel potential when the state POL=L is fixed in driving the non-display area. As shown in FIG. 8B, after the common potential LCCOM (non-display signal) is written in the pixel electrode 11 through the switch SWS of the DSG control circuit 21, if storage capacitor line driving is not performed and the potential of the storage capacitor line SC is not changed, a voltage to be applied to the pixel capacitor 12 is maintained at 0 V, and thus a non-display state can be maintained.

Figure 8C:
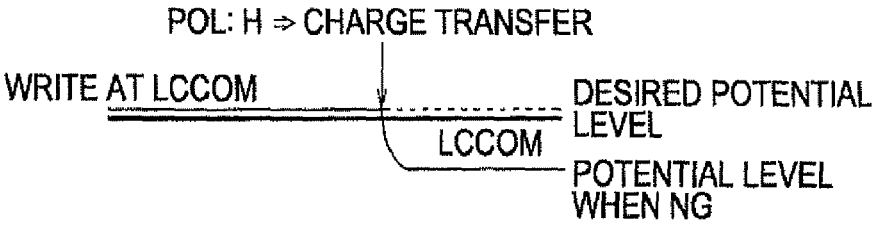

In contrast, as shown in FIG. 8C, when the state POL=H is changed to the state POL=L in driving the non-display area, after the common potential LCCOM (non-display signal) is written in the pixel electrode 11 through the switch SWS of the DSG control circuit 21, storage capacitor line driving is performed, and the potential of the storage capacitor line SC is changed. As a result, a voltage to be applied to the pixel capacitor 12 is changed from 0 V, and defective display may occur.

As such, if storage capacitor line driving is stopped when the display area is driven, or if storage capacitor line driving is activated when the non-display area is driven, an adverse affect on display may be caused.

When the display mode is switched from the full screen display mode to the partial display mode, as shown in (b) of FIG. 5, if a transition sequence is executed in the (n+1)th frame next to the n-th frame in which the frame inversion signal $POL_F$ is at the L level, an OK operation is performed such that the polarity signal POL is inverted in the display area, and the polarity signal POL is not inverted in the non-display area. Meanwhile, as shown in (c) of FIG. 5, if a transition sequence is executed in the (n+1)th frame next to the n-th frame in which the frame inversion signal $POL_F$ is at the H level, an NG operation is performed such that the polarity signal POL is inverted in the non-display area, and storage capacitor line driving is activated.

When a display area is changed in the partial display mode, as shown in (b) of FIG. 6, if a transition sequence is executed in the (n+1)th frame next to the n-th frame in which the frame inversion signal $POL_F$ is at the L level, an OK operation is performed such that the polarity signal POL is inverted in the display area and the polarity signal POL is not inverted in the non-display area. Meanwhile, as shown in (c) of FIG. 6, if a transition sequence is executed in the (n+1)th frame next to the n-th frame in which the frame inversion signal POL is at the H level, an NG operation is performed such that the polarity signal POL is inverted in an area, which is changed from the display area to the non-display area, and the polarity signal POL is not inverted in an area which is changed from the non-display area to the display area.

When the display mode is switched from the partial display mode to the full screen display mode, as shown in (b) of FIG. 7, if a transition sequence is executed in the (n+1)th frame next to the n-th frame in which the frame inversion signal $POL_F$ is at the L level, an OK operation is performed such that the polarity signal POL is inverted in the entire display area. Meanwhile, as shown in (c) of FIG. 7, if a transition sequence is executed in the (n+1)th frame next to the n-th frame in which the frame inversion signal $POL_F$ is at the H level, an NG operation is performed such that the polarity signal POL is not inverted in an area, which is changed from the non-display area to the display area.

If a transition sequence is executed in a frame in which the level of the frame inversion signal $POL_F$ corresponds to the polarity signal POL (L level) in the non-display area, an NG operation is performed, and defective display may occur.

In this embodiment, the sequence execution determination processing is performed by the sequence execution determination circuit 244, and a frame in which a transition sequence is executed is limited in accordance with the frame inversion signal $POL_F$.

The operation of the liquid crystal display of this embodiment will be described.

Figure 9:
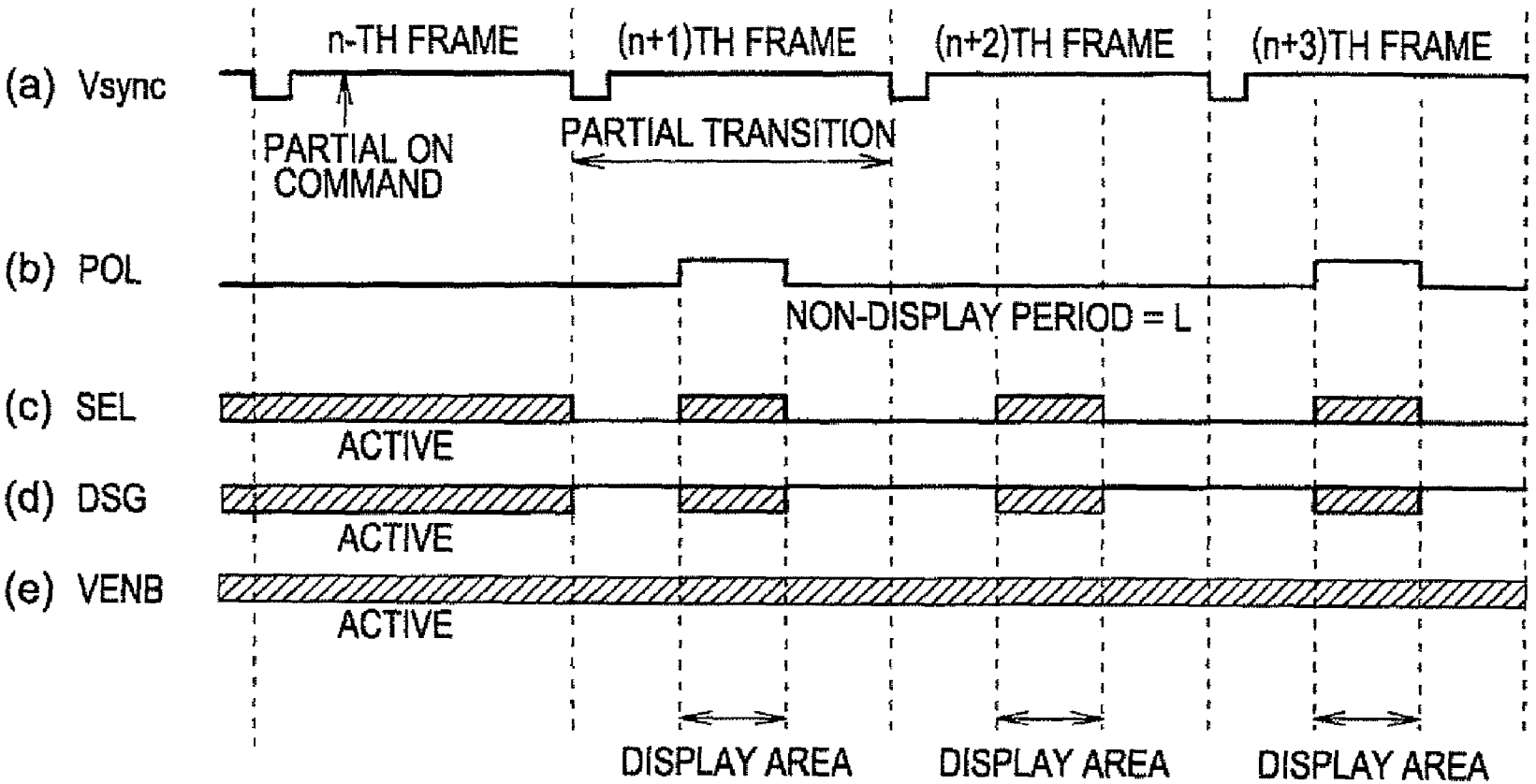
FIG. 9 is a timing chart illustrating the operation of this embodiment.
Figure 10:
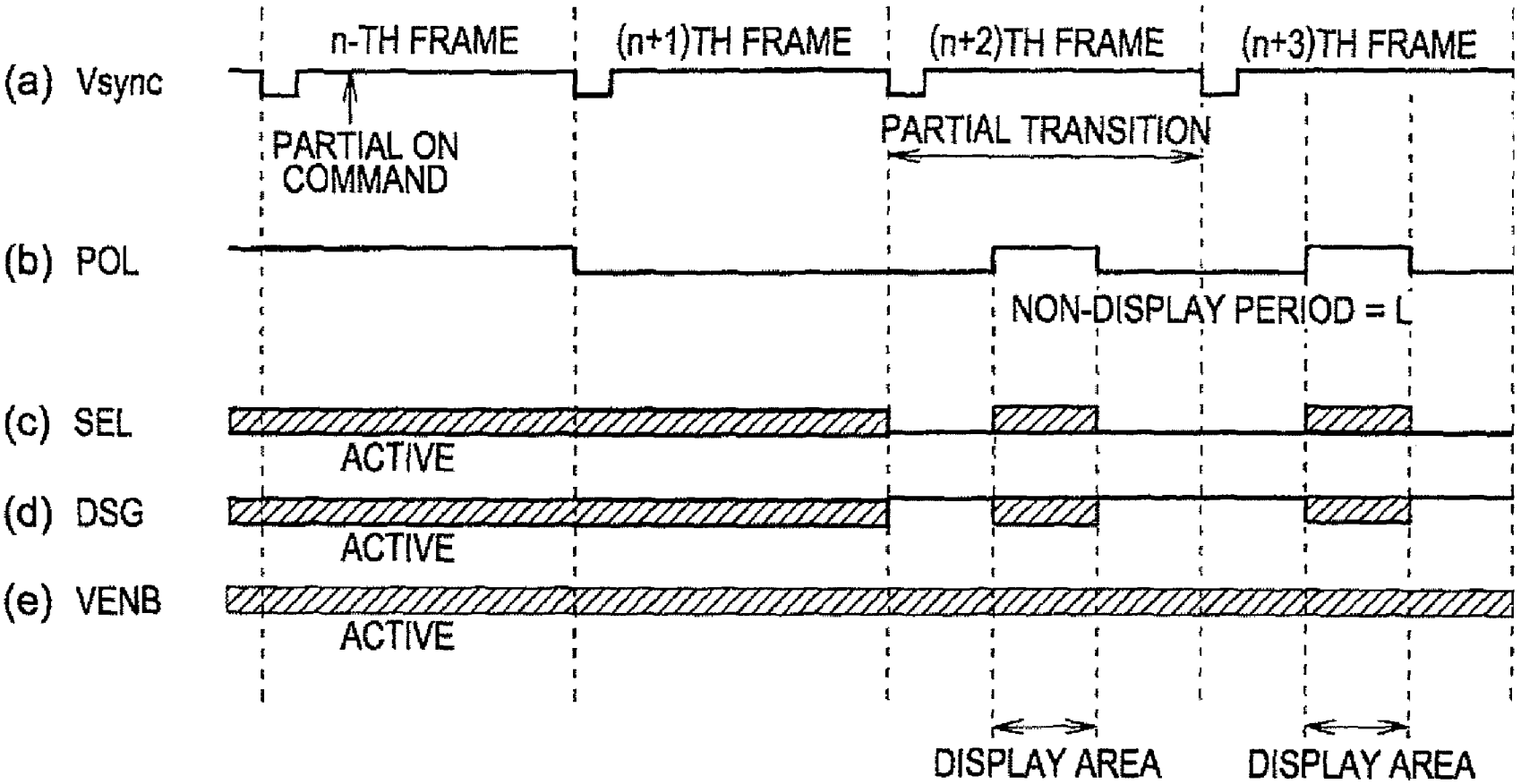
FIG. 10 is a timing chart illustrating the operation of this embodiment.

FIGS. 9 and 10 are timing charts illustrating an operation during a transition from the full screen display mode to the partial display mode in this embodiment. First, a case in which the partial ON command is received when the frame inversion signal $POL_F$ is at the L level will be described with reference to FIG. 9.

In the n-th frame, data "1" is stored in the memory 242 with respect to all the lines. In this case, if it is assumed that the frame inversion signal $POL_F$ is at the L level, the polarity signal POL=L for all the lines.

In the n-th frame, if the partial ON command is received, in the sequence execution determination processing of FIG. 4, the sequence execution determination circuit 244 determines Yes in Step S1. Then, the process progresses to Step S2, and it is determined whether or not the frame inversion signal $POL_F$ is at the L level. In this case, since $POL_F$=L, in Step S2, the result is determined to be Yes, and the process progresses to Step S3. In Step S3, data of the memory 242 is rewritten.

In this way, data of the memory 242 corresponding to the lines of the nondisplay area in the partial display mode is rewritten from "1" to "0", and the display mode is switched to the partial display mode from the (n+1)th frame.

Therefore, in the (n+1)th frame and later, the level of the polarity signal POL changes in the manner H→L→H→ . . . with respect to the lines corresponding to the display area frame by frame, and the polarity signal POL is fixed at the L level with respect to the lines corresponding to the non-display area.

In this case, in the (n+1)th frame (a first frame after the transition sequence is executed), an OK operation is performed such that the polarity signal POL is inverted in the display area, and the polarity signal POL is not inverted in the non-display area.

FIG. 10 is a timing chart showing a case in which the partial ON command is received when the frame inversion signal $POL_F$ is at the H level.

In the n-th frame, data "1" is stored in the memory 242 for all the lines. For this reason, in the n-th frame, the polarity signal POL=H for all the lines.

If the partial ON command is received in the n-th frame, in the sequence execution determination processing of FIG. 4, the sequence execution determination circuit 244 determines Yes in Step S1. Then, the process progresses to Step S2. In this case, since $POL_F$=H, in Step S2, the result is determined to be No, and the process waits until $POL_F$=L. For this reason, data of the memory 242 is not updated, and data "1" is kept to be stored for all the lines.

Therefore, in the (n+1)th frame, the full screen display mode is continuous. In the (n+1)th frame, the frame inversion signal $POL_F$ is inverted to the L level, and thus the polarity signal POL=L for all the lines.

In this case, the sequence execution determination circuit 244 determines Yes in Step S2, and the process progresses to Step S3. Thus, data in the memory 242 is rewritten. In this way, data of the memory 242 corresponding to the lines of the non-display area in the partial display mode is rewritten from "1" to "0", and the display mode is switched to the partial display mode from the (n+2)th frame.

Therefore, in the (n+2)th frame and later, the level of the polarity signal POL changes in the manner H→L→H→ . . . with respect to the lines corresponding to the display area frame by frame, and the polarity signal POL is fixed at the L level with respect to the lines corresponding to the non-display area.

In this case, in the (n+2) frame (a first frame after the transition sequence is executed), an OK operation is performed such that the polarity signal POL is inverted in the display area, and the polarity signal POL is not inverted in the non-display area.

In this way, the frame inversion signal $POL_F$ is detected, and the transition sequence is executed in a frame next to a frame in which the frame inversion signal $POL_F$ is at the L level. Therefore, occurrence of the above NG operation can be suppressed, and defective display can be suppressed.

Similarly, in the case of the change of the display area in the partial display mode and the transition from the partial display mode to the full screen display mode, if the frame inversion signal $POL_F$ is detected, and the transition sequence is executed in a frame next to a frame in which the frame inversion signal POL, is at the L level, defective display can be suppressed.

As described above, according to the embodiment, a polarity signal at a level corresponding to a frame inversion signal to be repeatedly inverted between the H level and the L level frame by frame is generated in the display area, and a polarity signal at a level corresponding to a fixed signal fixed at an L level is generated in the non-display area. The potential of the storage capacitor line is switched depending on the polarity signal. Therefore, storage capacitor line driving can be activated in the display area, and storage capacitor line driving can be stopped in the non-display area. As a result, the liquid crystal display can be driven with low power consumption.

When a transition sequence command is received, a transition sequence is executed at the timing according to the frame inversion signal. Therefore, defective display in the first frame when the transition sequence is executed can be suppressed.

As such, low power consumption can be achieved without damaging display quality.

When the transition sequence command is received, the transition sequence is executed in a frame next to a frame in which the frame inversion signal becomes the L level. Therefore, a frame in which the transition sequence is executed is limited, and in the first frame when the transition sequence is executed, it is possible to suppress the occurrence of the problem of storage capacitor line driving being stopped in the display area and storage capacitor line driving being activated in the non-display area. As a result, defective display can be reliably suppressed.

The transition sequence command is one of a partial ON command to request a change from a full screen display mode to a partial display mode, a normal ON command to request a change from a partial display mode to a full screen display mode, and an area change command to request a change of a display area in a partial display mode. Therefore, when the transition sequence is executed, defective display can be suppressed.

A polarity signal generation circuit includes a frame inversion signal generation circuit, a memory, and an AND circuit. Therefore, with a comparatively simple circuit configuration, a polarity signal to be inverted for each frame can be generated in the display area, and a polarity signal fixed at the L level can be generated in the non-display area.

In the partial display mode, a common potential is supplied to perform image display (non-display) in the non-display area. Therefore, a source write operation to write display signals from the source line driving circuit in the pixel electrodes 11 can be stopped. As a result, in the partial display mode which requires low power consumption, low power consumption can be achieved.

A switching element is provided which is connected to a power supply line for supplying a common potential and a source line, and allows electricity to be conducted between the power supply line and the source line at a predetermined timing. In the non-display area of the partial display mode, the switching element is controlled for one horizontal scanning period to allow electricity to be conducted between the power supply line and the source line. Therefore, with a comparatively simple circuit configuration, a COM write operation for supplying the common potential to the pixel electrode 11 of the non-display area can be performed.

In the foregoing embodiment, a case in which the polarity signal POL of the non-display area is fixed at the L level by the polarity signal generation circuit 24 has been described, but the polarity signal POL of the non-display area may be fixed at the H level. In this case, in Step S2 of FIG. 4, the sequence execution determination circuit 244 may determine whether or not the frame inversion signal $POL_F$ is at the H level. When $POL_F$=H, the process may progress to Step S3, and a sequence may be executed.

In the foregoing embodiment, a case in which the polarity signal generation circuit 24 includes the frame inversion signal generation circuit 241, the memory 242, and the AND circuit 243 has been described, any configuration may be used insofar as the polarity signal POL is inverted in the display area for each frame, and the polarity signal POL is fixed at the L level (or the H level) in the non-display area.

The entire disclosure of Japanese Patent Application NO. 2008-042508 filed Feb. 25, 2008 is expressly incorporated by reference herein.

What is claimed is:

1. A liquid crystal display that selectively operates in one of a full screen display mode, in which the full screen of the display panel is set as a display area, and a partial display mode, in which a partial area in the full screen is set as a display area and a remaining area is set as a non-display area, the liquid crystal display comprising:

a plurality of gate lines;

a plurality of source lines;

a plurality of storage capacitor lines that are provided to correspond to the plurality of gate lines;

a plurality of pixels that are provided at intersections between the plurality of gate lines and the plurality of source lines;

a polarity signal generation circuit that generates a polarity signal corresponding to a frame inversion signal to be repeatedly alternately inverted between a first level and a second level different from the first level frame by frame in the display area, and generates a polarity signal corresponding to a fixed signal fixed at one of the first level and the second level in the non-display area;

a storage capacitor line driving circuit that changes the potentials of the storage capacitor lines depending on the polarity signal generated by the polarity signal generation circuit; and a control circuit that changes the display area at a timing according to the frame inversion signal, wherein the control circuit changes the display area in a frame in which the level of the frame inversion signal is different from the fixed signal.

2. The liquid crystal display according to claim 1, wherein the change of the display area is one of a transition from the full screen display mode to the partial display mode, a transition from the partial display mode to the full screen display mode, and a change of the display area in the partial display mode.

3. The liquid crystal display according to claim 1, wherein the polarity signal generation circuit includes a frame inversion signal generation circuit that generates the frame inversion signal, a memory that stores data for identifying the display area and the non-display area, and a logic circuit that, when data output from the memory indicates the display area, outputs the polarity signal corresponding to the frame inversion signal, and when data output from the memory indicates the non-display area, outputs the polarity signal corresponding to the fixed signal, and the control circuit updates data stored in the memory to change the display area.

4. The liquid crystal display according to claim 3, wherein the logic circuit is an AND circuit to which data output from the memory and the frame inversion signal generated by the frame inversion signal generation circuit are applied.

5. The liquid crystal display according to claim 1, wherein each of the pixels includes a pixel switching element that is connected to a corresponding source line, a corresponding gate line, and a corresponding pixel electrode, and when the gate line is selected, allows electricity to be conducted between the pixel electrode and the source line, a pixel capacitor that is interposed between the pixel electrode and a common electrode to which a common potential is applied, and a storage capacitor that is interposed between the pixel electrode and a corresponding storage capacitor line, and in the partial display mode, the common potential is applied to the pixel electrodes of the pixels corresponding to the non-display area.

6. The liquid crystal display according to claim 5, wherein a switching element is provided which is connected to a power supply line for supplying the common potential and the source line, and allows electricity to be conducted between the power supply line and the source line at a predetermined timing, and in the non-display area of the partial display mode, for one horizontal scanning period, the switching element is controlled to allow electricity to be conducted between the power supply line and the source line.

7. A method of driving a liquid crystal display, which selectively operates in one of a full screen display mode, in which the full screen of the display panel is set as a display area, and a partial display mode, in which a partial area in the full screen is set as a display area and a remaining area is set as a non-display area, wherein the liquid crystal display includes a plurality of gate lines, a plurality of source lines, a plurality of storage capacitor lines that are provided to correspond to the plurality of gate lines, and a plurality of pixels that are provided at intersections between the plurality of gate lines and the plurality of source lines, and the method comprising:

generating a polarity signal corresponding to a frame inversion signal to be repeatedly inverted between a first level and a second level frame by frame in the display area, and generating a polarity signal corresponding to a fixed signal fixed at one of the first level and the second level in the non-display area;

changing the potentials of the storage capacitor lines depending on the polarity signal; and changing the display area at a timing according to the frame inversion signal, wherein the control circuit changes the display area in a frame in which the level of the frame inversion signal is different from the fixed signal.

8. A liquid crystal display that selectively operates in one of a full screen display mode, in which the full screen of the display panel is set as a display area, and a partial display mode, in which a partial area in the full screen is set as a display area and a remaining area is set as a non-display area, the liquid crystal display comprising:

a plurality of gate lines;

a plurality of source lines;

a plurality of storage capacitor lines that are provided to correspond to the plurality of gate lines;

a plurality of pixels that are provided at intersections between the plurality of gate lines and the plurality of source lines;

a polarity signal generation circuit that generates a polarity signal corresponding to a frame inversion signal to be repeatedly alternately inverted between a first level and a second level different from the first level frame by frame in the display area, and generates a polarity signal corresponding to a fixed signal fixed at one of the first level and the second level in the non-display area;

a storage capacitor line driving circuit that changes the potentials of the storage capacitor lines depending on the polarity signal generated by the polarity signal generation circuit; and a control circuit that changes the display area at a timing according to the frame inversion signal, wherein the polarity signal generation circuit includes a frame inversion signal generation circuit that generates the frame inversion signal, a memory that stores data for identifying the display area and the non-display area, and a logic circuit that, when data output from the memory indicates the display area, outputs the polarity signal corresponding to the frame inversion signal, and when data output from the memory indicates the non-display area, outputs the polarity signal corresponding to the fixed signal, and the control circuit updates data stored in the memory to change the display area.

9. The liquid crystal display according to claim 8, wherein the logic circuit is an AND circuit to which data output from the memory and the frame inversion signal generated by the frame inversion signal generation circuit are applied.

10. The liquid crystal display according to claim 8, wherein each of the pixels includes a pixel switching element that is connected to a corresponding source line, a corresponding gate line, and a corresponding pixel electrode, and when the gate line is selected, allows electricity to be conducted between the pixel electrode and the source line, a pixel capacitor that is interposed between the pixel electrode and a common electrode to which a common potential is applied, and a storage capacitor that is interposed between the pixel electrode and a corresponding storage capacitor line, and in the partial display mode, the common potential is applied to the pixel electrodes of the pixels corresponding to the non-display area.

11. The liquid crystal display according to claim 8, wherein a switching element is provided which is connected to a power supply line for supplying the common potential and the source line, and allows electricity to be conducted between the power supply line and the source line at a predetermined timing, and in the non-display area of the partial display mode, for one horizontal scanning period, the switching element is controlled to allow electricity to be conducted between the power supply line and the source line.

12. The liquid crystal display according to claim 8, wherein the change of the display area is one of a transition from the full screen display mode to the partial display mode, a transition from the partial display mode to the full screen display mode, and a change of the display area in the partial display mode.

* * * * *